US007790996B2

(12) United States Patent
Swamy et al.

(10) Patent No.: US 7,790,996 B2
(45) Date of Patent: Sep. 7, 2010

(54) STATUS INDICATION FOR EMERGENCY STOP PUSH BUTTON

(75) Inventors: Muddaiah Swamy, Plainville, CT (US); Juan Manuel Arcas, Madrid (ES); Sreekumar Krishnalayam Vasudevanpillai, Bangalore (IN)

(73) Assignee: General Electric Company, Schenectady, NY (US)

( * ) Notice: Subject to any disclaimer, the term of this patent is extended or adjusted under 35 U.S.C. 154(b) by 525 days.

(21) Appl. No.: 11/776,840

(22) Filed: Jul. 12, 2007

(65) Prior Publication Data

US 2009/0014306 A1 Jan. 15, 2009

(51) Int. Cl.
*H01H 3/12* (2006.01)

(52) U.S. Cl. ..... 200/318.2; 200/308; 200/530

(58) Field of Classification Search ..... 200/308, 200/341, 345, 520, 523, 529, 530, 531, 538–541, 200/318.2

See application file for complete search history.

(56) References Cited

U.S. PATENT DOCUMENTS

| | | | | |
|---|---|---|---|---|
| 4,182,943 | A * | 1/1980 | Butterworth | 200/318.2 |
| 5,055,643 | A | 10/1991 | Pardini et al. | |
| 5,593,022 | A | 1/1997 | Schaeffer et al. | |
| 5,605,225 | A | 2/1997 | Schaeffer et al. | |
| 5,679,936 | A * | 10/1997 | Schaeffer et al. | 200/17 R |

FOREIGN PATENT DOCUMENTS

| | | | |
|---|---|---|---|
| DE | 196 07 562 | C2 | 2/1996 |
| EP | 0667631 | A | 8/1995 |
| EP | 0713231 | A | 5/1996 |
| EP | 1296343 | A | 3/2003 |

* cited by examiner

*Primary Examiner*—Renee S Luebke
*Assistant Examiner*—Marina Fishman
(74) *Attorney, Agent, or Firm*—Global Patent Operation; Stephen G. Midgley

(57) ABSTRACT

An emergency push-button includes a housing that, in turn, includes at least one guide surface and an actuator supported by the housing. The actuator may be reciprocable along a generally linear axis between an actuated position and a released position. The actuator has at least one indicator window located thereon. The emergency push-button may further include an indicator disposed proximal to the actuator head and being biased for movement therewith. The indicator may include an indicator surface that has indicia thereon that provides status of the emergency push-button and that is configured to be selectably viewable through the indicator window of the actuator head. The indicator further includes at least one arm extending therefrom that is engageable with the at least one guide surface. Upon reciprocation of the actuator head to the actuated position, the at least one arm is configured to be urged by the at least one guide surface of the housing to a position whereby the indicator is moved and, in turn, the indicia, to reflect a change in status that is viewable through the at least one window.

13 Claims, 3 Drawing Sheets

STATUS INDICATION FOR EMERGENCY STOP PUSH BUTTON

BACKGROUND OF THE INVENTION

The present invention relates to an emergency push-button having safe actuation, obtained through tripping, of the kind used for providing safety interventions on electrical, electromechanical or electronic devices or plants in order to obviate problems or to intervene the fastest possible in emergency situations.

Such a kind of emergency push-buttons are largely used for example, but not exclusively, on carrying or lifting devices, such as conveying belts, elevators, cranes, escalators and lifts, or in monitoring and alert plants against accidents, such as fires, blastings, floods, or crimes, such as stealings, hooliganisms, damages or the like.

There are already many emergency push-buttons and one of the objects sought to be obtained therethrough is a safe actuation, i.e. the safety that, once they are actuated, not only they interrupt their action or are deactuated, but they can be deactuated only at will by an explicit deactuating action. Further, said emergency push-buttons, must operate switches actuated by them even in case of failures of their components or damages to the contacts, such as light welding thereof.

All the emergency push-buttons, to meet the safety international regulations, are provided with a large knob or slider, having mushroom shape, which is actuable by a hand palm to permit the fastest and the safest the possible intervention.

One exemplary emergency push-button is described in U.S. Pat. No. 5,055,643 and which comprises a housing and a support rigidly connected to a movable actuation knob and axially movable therewith. The support acts on a releasing mechanism, operated by rotation of the knob about an axis parallel to the movement direction of the movable slider. The button further includes an axially movable member provided with at least one retaining tooth, which, upon lowering of the movable knob, rotates about an axis parallel to the moving direction of the knob, compelling the retaining tooth to release at least one protrusion provided on the housing and, once the movable member has cleared through a tripping action, it also rotates in a tripping manner carrying the retaining tooth to the position under the protrusion, preventing the movable member from moving back to a raised position thereof. The release of the retaining tooth may be obtained just through a rotating movement of the knob in a reversed direction with respect to the retaining movement. A cylinder lock may be provided within a knob.

It is now desired to provide an emergency push-button with a status indicator that is readily recognizable to a viewer.

BRIEF DESCRIPTION OF THE INVENTION

In accordance with an embodiment of the present invention an emergency push-button comprises a housing that, in turn, comprises at least one guide surface and an actuator supported by the housing. The actuator may be reciprocable along a generally linear axis between an actuated position and a released position. The actuator has at least one indicator window located thereon. The emergency push-button may further comprise an indicator disposed proximal to the actuator head and being biased for movement therewith. The indicator may comprise an indicator surface that has indicia thereon that provides status of the emergency push-button and that is configured to be selectably viewable through the indicator window of the actuator head. The indicator further comprises at least one arm extending therefrom that is engageable with the at least one guide surface. Upon reciprocation of the actuator head to the actuated position, the at least one arm is configured to be urged by the at least one guide surface of the housing to a position whereby the indicator is moved and, in turn, the indicia, to reflect a change in status that is viewable through the at least one window.

BRIEF DESCRIPTION OF THE DRAWINGS

The following detailed description is made with reference to the accompanying drawings, in which.

DETAILED DESCRIPTION OF THE PREFERRED EMBODIMENT

One embodiment of the present invention concerns a device and a method for providing status indication for an emergency push-button. The emergency push-button may comprise a housing and an actuator supported by the housing and having at least one indicator window located thereon. An indicator may be provided that comprises an indicator surface having indicia that indicates the status of the emergency push-button and, upon reciprocation of the actuator head to the actuated position, the indicia, viewable at selected times through the indicator window of the actuator head, may be varied to reflect a change in status.

Figure 1:
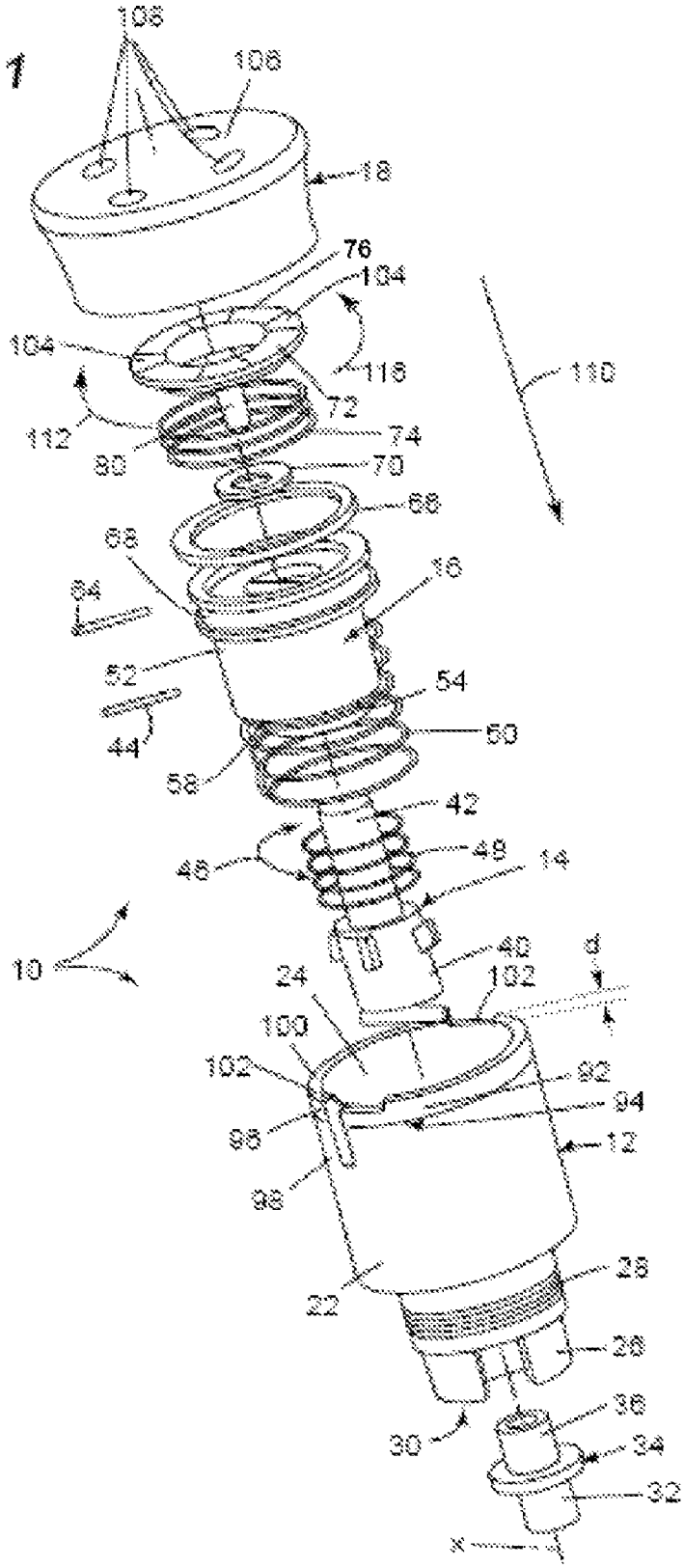
FIG. 1 is an exploded view of an emergency push-button in accordance with an embodiment of the present invention.

Referring now to FIG. 1, an emergency push-button in accordance with one embodiment of the present invention is illustrated generally at 10. In this embodiment, the emergency push-button 10 may comprise a housing 12, a plunger 14, a rotor 16, actuator 18 and an indicator 20. Each of the foregoing components and others described herein unless otherwise noted may comprise a generally rigid, insulative and moldable substance such as a polymeric substance including polyamide, high impact polyethylene and/or polycarbonate.

The housing 12 may comprise a cup portion (not numbered) having a generally cylindrical outer configuration and that comprises a housing wall 22 that defines a housing cavity 24. A stem portion 26 extends from the housing wall 22 and may be threaded as shown at 28 for assembly to a base (not shown). The stem portion 26 may comprise a stem cavity 30 dimensioned to receive a portion of the plunger 14, as described below, and to receive a portion of a piston 32, also described below.

Figure 2:
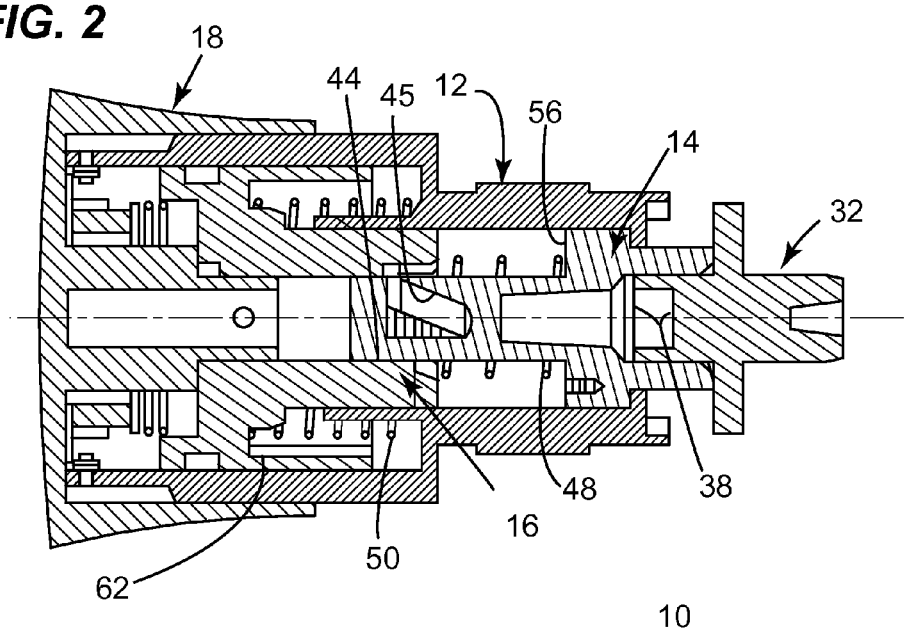
FIG. 2 is a cross-sectional view of the emergency push-button of FIG. 1.

The piston 32 comprises a generally cylindrical configuration including a larger diameter stop portion 34 and a plug portion 36. Referring now also to FIG. 2, the plug portion 36 may comprise a plug cavity 38 which is dimensioned to fit within the stem cavity 30.

The plunger 14 comprises a base portion 40 and a stem 42 that comprises a pin 44 that is movable within a guide 45 along a generally helical path as represented by arrow 46. The rotor 16 may be interconnected with the pin 44 which, during movement of the rotor, causes axial and rotational movement of the plunger 14. Further details of a similar device for providing for reciprocal axial movement within an emergency push-button may be found in U.S. Pat. No. 5,055,643 that is described above and is incorporated herein to the extent necessary to make and practice an embodiment of the invention.

The rotor 16 may be supported by the plunger 14 and the housing 12 and is biased away from both by springs 48 and 50, respectively. The rotor 16 may comprise a larger diameter outer portion 52 and a smaller diameter inner portion 54 wherethrough the pin 44 may extend. Spring 48 extends between a shoulder 56 of the plunger 14 and an end surface 58 of the rotor 16. The spring 50 is located between a recessed portion of the housing 12 and a shoulder portion 62 of the rotor 16. A pin 64 connects the rotor 16 and actuator 18.

A gasket ring 66 is disposed within a groove 68 of the rotor 16 for providing ingress protection and a gasket ring 70 is also provided for ingress protection.

In accordance with a feature of the present invention, an indicator 72 is located between the rotor 16 and the actuator 18. The indicator 72 may be biased by a spring 74 in the direction of a screen 76.

Figure 3:
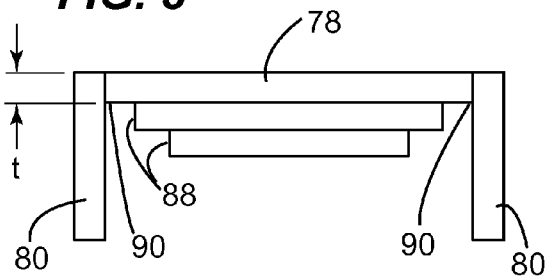
FIG. 3 is a side view of an indicator of the emergency push-button of FIG. 1.
Figure 4:
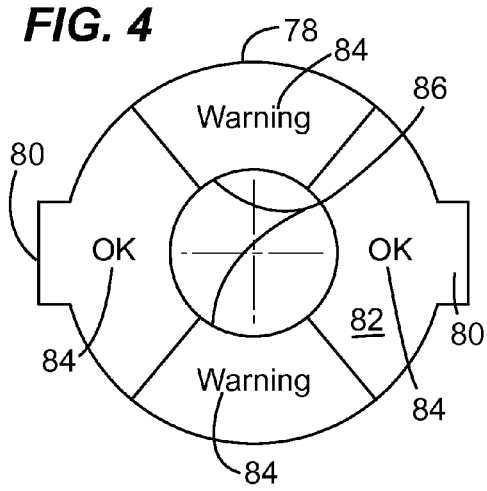
FIG. 4 is a top view of the indicator of FIG. 3.

Referring now to FIGS. 3 and 4, the indicator 72 comprises a hub 78 and arms 80. The hub 78 comprises an indicator surface 82 that comprises indicia such as a writing 84. It will be appreciated that instead of, or in addition to, the writing 84, a color scheme such as red and green or a structural flagging element that is movable to signal an actuated or released position, may be employed. The indicator 72 also comprises an aperture 86 and a stepped portion 88 provided for receiving the spring 74. Shoulder portions 90 are connected with each arm 80.

Referring again to FIG. 1, the housing 12 comprises a pair of reduced diameter portions 92 and guide surfaces 94, although, only one is seen in FIG. 1 as each is located diametrically opposed on the housing 12. The guide surface 94 comprises a sloped portion 96 and a generally flat portion 98. The sloped portion may be disposed at an angle with respect to a linear or center axis X that is in the range of between approximately 45 degrees and approximately 75 degrees. In one particular embodiment the angle is approximately 60 degrees. The housing 12 terminates in a housing wall end surface 100 that comprises a pair of divot portions 102 that are configured in depth (d) to generally equal a thickness (t) of the shoulder portions 90.

The screen 76 may comprise a low friction material such as that sold under the trademark "LEXAN" available from the General Electric Company of Fairfield, Conn. and functions to facilitate rotational movement by the indicator 72 relative to the actuator 18. The screen 76 may comprise apertures 104 that provide for viewing of the indicia 84 as described below.

The actuator 18 comprises a working surface 106 on which ports or windows 108 are located. The indicia 84 may be seen by an operator through the windows 108 as shown in FIG. 5.

Figure 5:
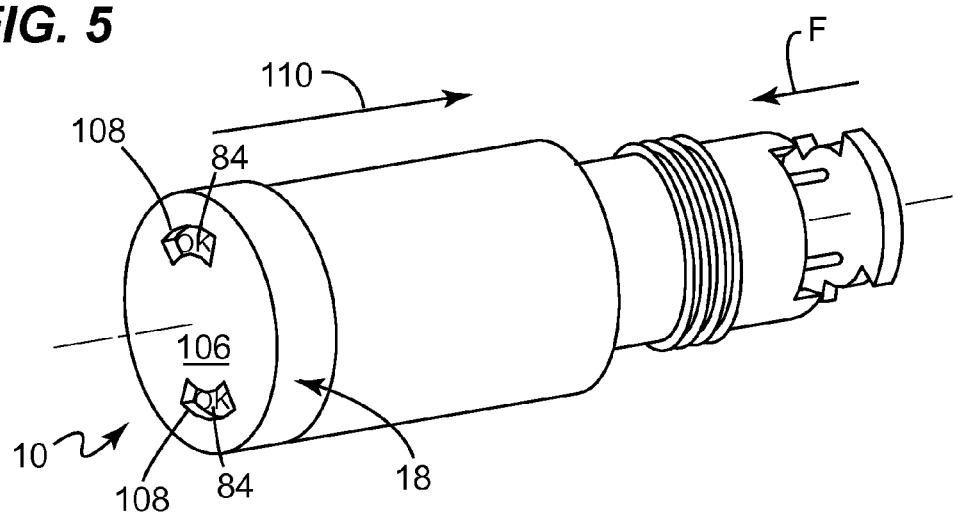
FIG. 5 is a perspective view of the emergency push-button of FIG. 1 in a released position.
Figure 6:
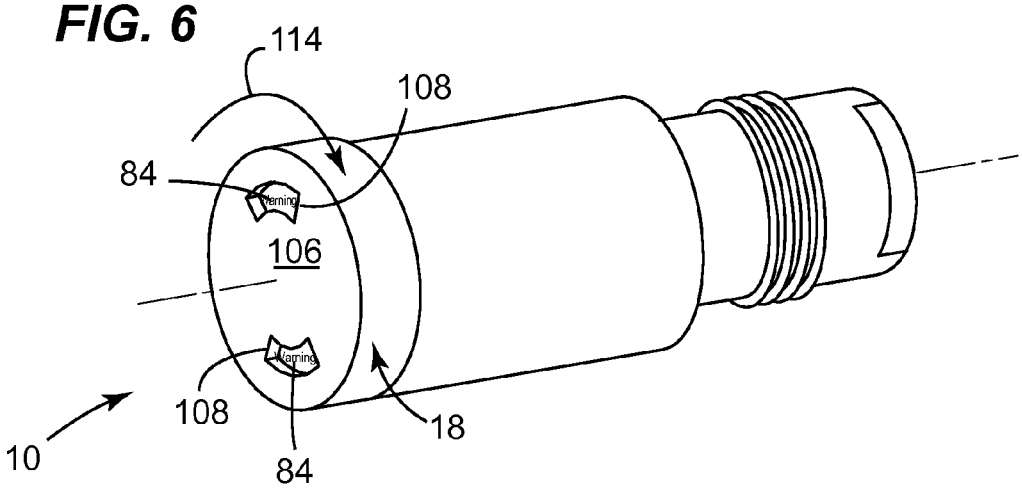
FIG. 6 is a perspective view of the emergency push-button of FIG. 1 in an actuated position.

In operation, as seen in FIGS. 5 and 6, the emergency push-button 10 may be reciprocated between a released position and an actuated position. As seen in FIG. 5, the emergency push-button may be moved in the direction of arrow 110 via engagement by an operator's palm with the working surface 106 and by the effect of a counter force F, supplied by a support such as a wall (not shown). Upon the movement of the actuator 18, the rotor 16 moves axially and, in turn, the indicator 72 rotates as the arms 80 follow a guide surface 94 in a clockwise direction as illustrated by arrow 112 and an axial movement in the direction of arrow 110. Upon rotation of the indicator 72, the indicia 84 of the indicator surface 82 is rotated from "Ok" to "Warning" as shown in FIG. 6.

To return the emergency push-button 10 to a released position, shown in FIG. 5, the actuator 18 is rotated clockwise in the direction of arrow 114. In this way, guide surfaces 94 now cause the indicator 72 to rotate changing indicia 84 from "Warning" to "Ok".

While the present invention has been described in connection with what are presently considered to be the most practical and preferred embodiments, it is to be understood that the present invention is not limited to these herein disclosed embodiments. Rather, the present invention is intended to cover all of the various modifications and equivalent arrangements included within the spirit and scope of the appended claims.

What is claimed is:

1. An emergency push-button device, comprising:

a housing comprising at least one guide surface;

an actuator supported by the housing and being reciprocable along a generally linear axis between an actuated position and a released position, the actuator having at least one indicator window located thereon; and an indicator disposed proximal to the actuator and being biased for movement therewith, the indicator comprising an indicator surface having indicia thereon that provides status of the emergency push-button and that is configured to be selectably viewable through the at least one indicator window of the actuator, the indicator comprising at least one arm extending therefrom and being engageable with the at least one guide surface and upon reciprocation of the actuator to the actuated position the at least one arm is configured to be urged by the at least one guide surface of the housing to a position whereby the indicator is moved and, in turn, the indicia, to reflect a change in status that is viewable through the at least one indicator window;

wherein the indicator is rotatably disposed and rotates to a position where the indicia is viewable through the at least one indicator window;

wherein the actuator comprises a working surface and the at least one indicator window is located on the working surface; and wherein the housing comprises a housing cavity and further comprising:

a rotor biased within the housing cavity and being rotatable about a rotor axis that is generally parallel to the linear axis of the actuator;

a pin;

a plunger also located within the housing cavity and being interconnected with the rotor via the pin and having a cavity dimensioned and configured to provide a helical path for the pin; and a piston, engageable with the plunger and supporting the plunger.

2. The device of claim 1, wherein the indicia comprises at least one from the group consisting of a color, a writing and a structural flag.

3. The device of claim 1, further comprising an indicator screen located between the actuator and the indicator.

4. The device of claim 3, wherein the indicator screen comprises a generally thin disk comprising at least one aperture and a low friction material comprising at least one from the group consisting of a polyamide, a polyethylene and a polycarbonate.

5. The device of claim 1, wherein the housing is generally cylindrical in configuration and comprises a housing wall defining the housing cavity, the housing wall comprising a housing wall outer surface whereon the housing guide surface extends; and the actuator is generally cylindrical in configuration and comprises an actuator wall that is dimensioned and configured to fit over the housing wall.

6. The device of claim 5, wherein the at least one guide surface comprises a sloped portion and a generally flat portion.

7. The device of claim 6, wherein:

the at least one indicator arm comprises a pair of indicator arms;

the at least one guide surface comprises a pair of guide surfaces; and each indicator arm is configured to bear against a respective guide surface.

8. The device of claim 6, wherein the sloped portion is disposed at an angle that is in the range of between approximately forty-five degrees and approximately seventy-five degrees to the linear axis.

9. The device of claim 8, wherein the sloped portion is disposed at an angle that is approximately sixty degrees to the linear axis.

10. The device of claim 7, wherein the housing wall outer surface is generally cylindrical and each guide surface extends generally perpendicularly in a radial direction from the housing wall outer surface and each terminates at a reduced diameter portion of the housing wall.

11. The device of claim 10, wherein:

the housing wall outer surface terminates in a housing wall end surface comprising a pair of divot portions; and the indicator comprises a generally stepped disc like shape, an indicator aperture, a first diameter portion and a second diameter portion and wherein each arm extends from a shoulder portion connected with the first diameter portion and wherein each shoulder portion is dimensioned and configured to mate with each divot portion of the housing wall and each arm is dimensioned and configured to fit adjacent each reduced diameter portion of the housing wall.

12. The device of claim 11, wherein each arm comprises a generally triangular outer configuration with a generally blunt end tip that engages a respective guide surface.

13. The device of claim 12, wherein each of the actuator, indicator and housing comprise a polymeric substance.

* * * * *